US006019681A

United States Patent [19]

Oishi et al.

[11] Patent Number: 6,019,681

[45] Date of Patent: Feb. 1, 2000

[54] SIMULATIVE QUICK-FIRING GUN

[75] Inventors: Toshimitsu Oishi; Kojiro Minami, both of Kobe, Japan

[73] Assignee: Konami Co., Ltd., Hyogo-ken, Japan

[21] Appl. No.: 08/972,168

[22] Filed: Nov. 17, 1997

[30] Foreign Application Priority Data

Nov. 20, 1996 [JP] Japan ..... 8-309294

[51] Int. Cl.[7] ..... A63F 9/22; A63F 9/02

[52] U.S. Cl. ..... 463/49; 434/16; 434/18; 446/401; 446/405

[58] Field of Search ..... 463/49, 52, 56, 463/50, 2, 5, 51, 53–57; 446/401, 404, 405, 473, 402; 434/10, 18

[56] References Cited

U.S. PATENT DOCUMENTS

| | | | |
|---|---|---|---|
| 1,743,337 | 1/1930 | Fey | 434/16 |
| 3,990,704 | 11/1976 | Meyer et al. | 463/52 |
| 4,007,934 | 2/1977 | Ochi | 434/16 |
| 4,079,525 | 3/1978 | Linton et al. | 434/16 |
| 4,109,608 | 8/1978 | Horikawa | 434/16 |
| 4,808,143 | 2/1989 | Kuo | 446/406 |
| 4,923,402 | 5/1990 | Marshall et al. | 463/52 |
| 5,004,444 | 4/1991 | Chih | 446/406 |
| 5,059,150 | 10/1991 | Kuo | 446/405 |
| 5,569,085 | 10/1996 | Igarashi et al. | 463/49 |

FOREIGN PATENT DOCUMENTS

| | | |
|---|---|---|
| 63-29147 | 6/1988 | Japan . |
| 8103562 | 4/1996 | Japan . |
| 889661 | 4/1996 | Japan . |
| 8294582 | 11/1996 | Japan . |

*Primary Examiner*—Jessica J. Harrison
*Assistant Examiner*—John Hotaling, II
*Attorney, Agent, or Firm*—Jordan and Hamburg LLP

[57] ABSTRACT

A simulative quick-firing gun includes a shooting detector and an impact generator for generating an impact in accordance with detection of a shooting. The impact generator includes a motor, an impacter movable reciprocatingly in a specified direction of the housing, and a conversion mechanism for converting a torque of the motor to a reciprocating movement of the impacter. The impacter is provided with an impact weight member and a reciprocating rod carrying the impact weight member on an end thereof and operatively connected with the driving rod by a linking mechanism.

9 Claims, 4 Drawing Sheets

SIMULATIVE QUICK-FIRING GUN

BACKGROUND OF THE INVENTION

This invention relates to a simulative quick-firing gun provided with an impact generator when performing a shooting.

In recent years, a video game system in which a shooting is performed at a target displayed on the screen of a monitor by a simulative gun has come into wide use. A simulative gun used in this video game system includes a light detector having a high directivity. The light detector carried by the gun detects light from a directed spot of the screen of the monitor. In this video game system, whether or not a target is successfully shot is judged by comparing detected positional data of the light detector with positional data of the target.

It may be appreciated to use a simulative quick-firing gun capable of performing rapid successive shootings for such video game system. Also, to enhance the actuality in the game, it may be appreciated to generate an impact each shooting. However, it has been very difficult to generate impacts in synchronism with continuous rapid shootings. Thus, the player cannot obtain the feeling of actual shooting of a quick-firing gun, namely, to feel an impact and a recoil as would occur when shooting bullets in rapid succession by an actual gun.

SUMMARY OF THE INVENTION

It is an object of the present invention to provide a simulative quick-firing gun which makes it possible for the player to obtain the feeling of actual shooting of a quick-firing gun.

According to an aspect of the present invention, a simulative quick-firing gun comprises: a shooting detector for detecting a shooting operation; and an impact generator for generating an impact in accordance with detection of the shooting operation. The impact generator is provided with a motor, an impacter movable reciprocatingly in a specified direction, and a conversion mechanism for converting a torque of the motor to a reciprocating movement of the impacter.

In this simulative quick-firing gun, the impacter is reciprocatingly moved by converting the torque of the motor to a reciprocating movement of the impacter. A kinetic energy conserved during the movement of the impacter is transmitted to the body of the gun when changing the movement direction of the impacter. Accordingly, successive impacts can be readily generated on the gun, thus enabling the player to obtain the feeling of actual firing of a real quick-firing gun even when a large number of shootings are fired in a rapid succession in a short time like a machine gun.

Other features, objects and advantages of the present invention will become apparent from the following description of preferred embodiments with reference to the drawings.

DETAILED DESCRIPTION OF THE PREFERRED EMBODIMENTS

Figure 1:
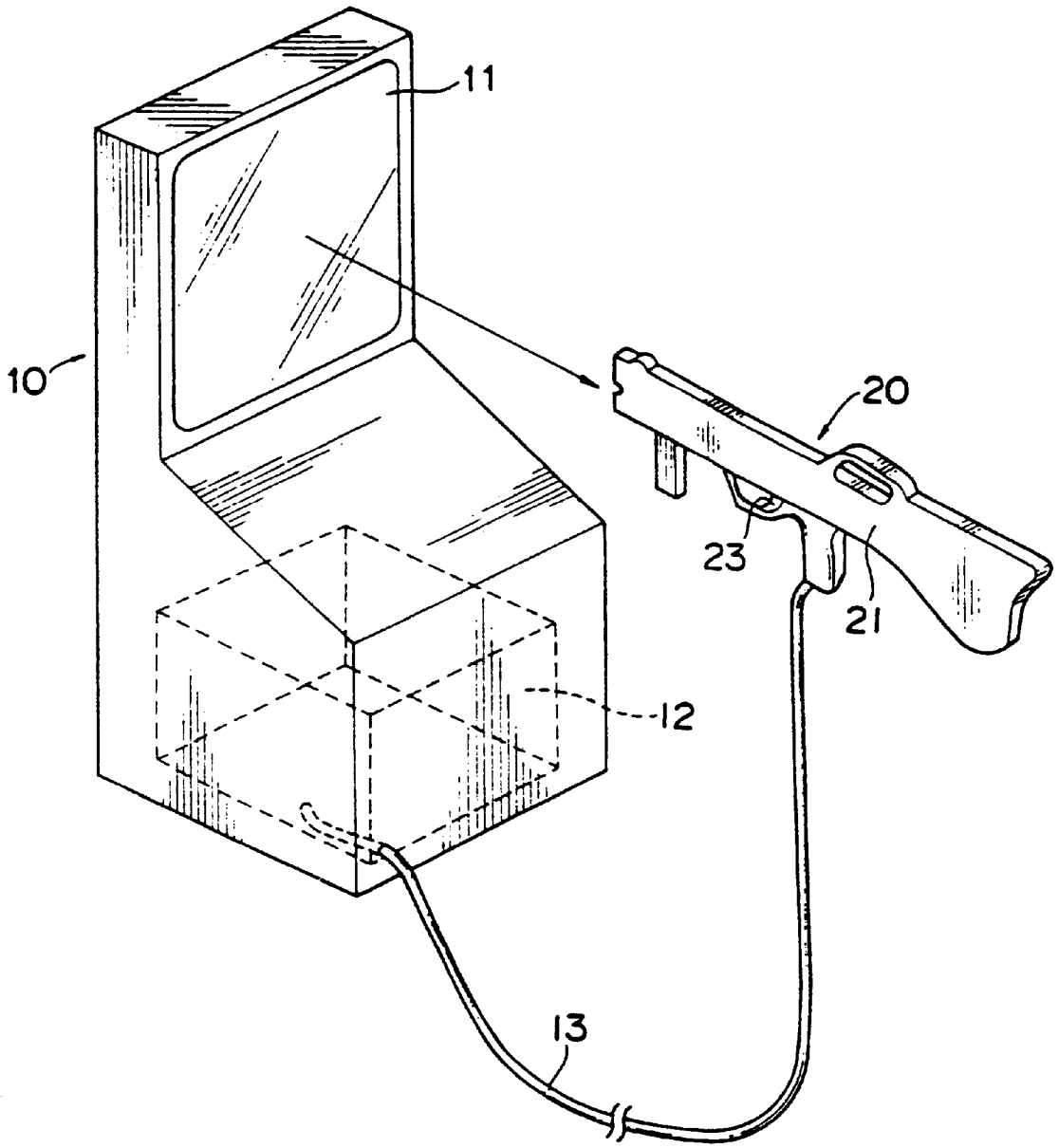
FIG. 1 is a perspective view illustrating a video game system including a simulative quick-firing gun embodying the present invention.

FIG. 1 is a perspective view illustrating a video game system provided with a simulative quick-firing gun of the present invention. In this figure, a video game system comprises a main unit 10 and a simulative quick-firing gun 20.

The main unit 10 of the video game system includes a display portion 11 provided with a CRT or LCD monitor on a screen of which a target for the simulative quick-firing gun is displayed. Also, the main unit 10 includes a control portion 12 for controlling the development of a game in accordance with installed programs and a shooting direction of the simulative quick-firing gun 20. The control portion generates and sends an image signal for new display image to the display portion 11.

The control portion 12 has a horizontal counter and a vertical counter which are synchronism with scanning of the screen of the display portion 11. The control portion 12 controls the position of a target on the screen of the display portion 11.

Figure 2:
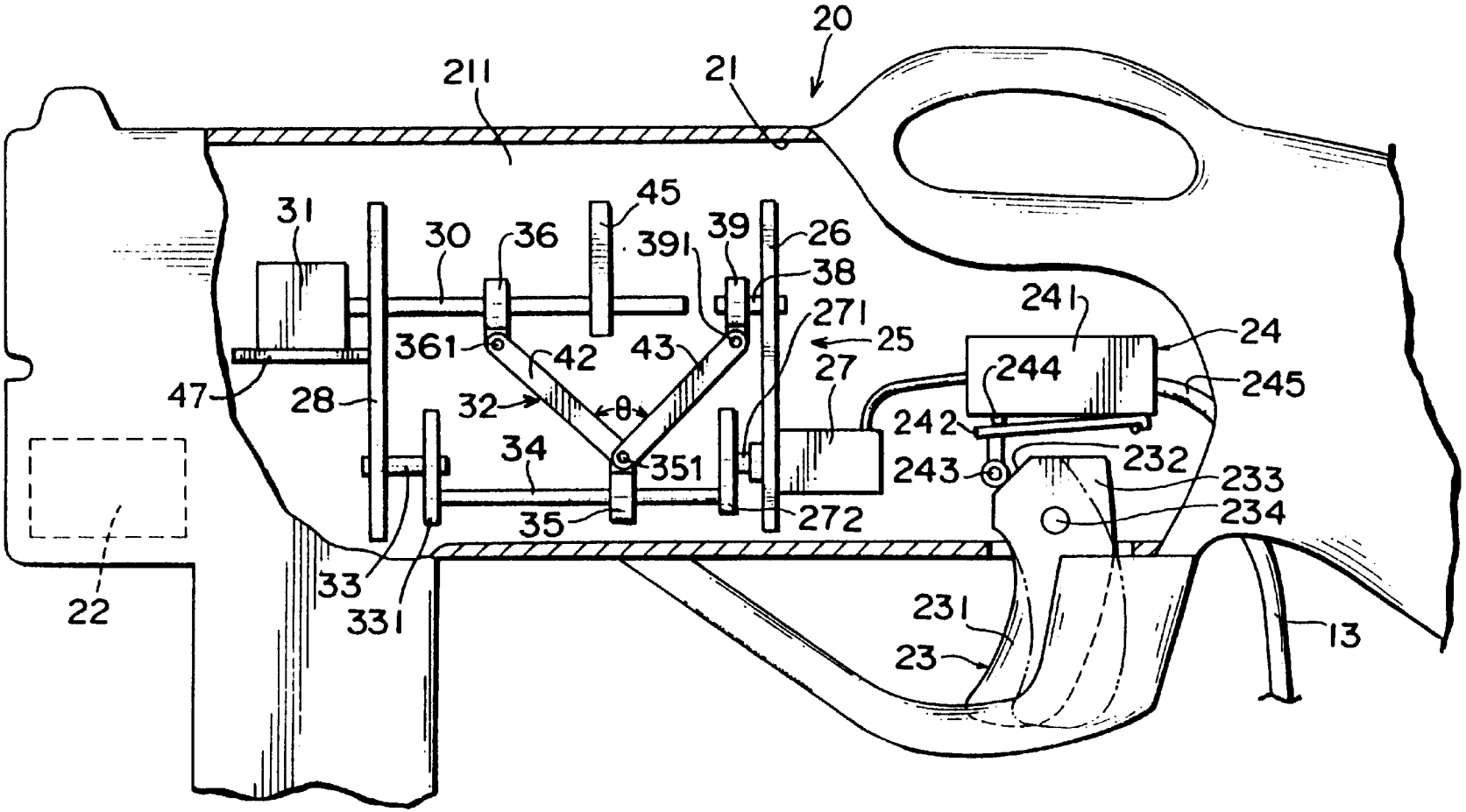
FIG. 2 is a side view of the simulative quick-firing gun, a housing of the gun being partially removed to illustrate an internal structure of a main portion of the gun.

Referring to FIG. 2 showing an internal structure of a main portion of the simulative quick-firing gun 20, the simulative quick-firing gum 20 includes a light detector 22 having a high directivity in a front portion of a housing 21 of the gun 20, a trigger 23, a micro-switch 24 for detecting a shooting operation of the trigger 23, and an impact generator for generating an impact when the trigger 23 is operated. In the simulative quick-firing gun 20, light from a given spot of the screen is detected by the light detector 22 when the trigger 23 is operated.

The trigger 23 has a manipulating portion 231 at which a finger is put, and an operation portion 233 disposed within the housing 21, and a slope portion 232. The trigger 23 is rotatably supported on a pivotal shaft 234. The trigger 23 is usually stayed at the position represented by the solid lines by a coil spring.

The micro-switch 24 is provided with a switch casing 241 therein, an operation lever 242 swingably mounted on a bottom surface of the switch casing 241, a roller 243 supported on an end of the operation lever 242, a contactor 244 provided in the bottom of the switch casing 241, and a cord 245 for transmitting a switch signal.

When the trigger 23 is operated or pulled back to the position represented by the phantom lines, the roller 243 is pushed up along the slope portion 232 of the trigger 23. The operation lever 242 is swung up and the contactor 244 is pushed in. Consequently, the switch is turned on.

The impact generator 25 includes a motor 27 mounted on a first support member 26 provided in the housing 21 of the gun 20. A rotary shaft 271 of the motor 27 is directed to the front (namely, to the left in FIG. 2) of the gun housing 21. The impact generator 25 is also provided with a reciprocating rod 30 extending through a second support member 28 disposed in the front of the first support member 26, and a third support member 45 disposed between the first support member 26 and the second support member 28. The reciprocating rod 30 is reciprocatingly movable in axial directions of a barrel 211 of the gun housing 21. An impact weight member 31 is attached to the front end of the reciprocating rod 30 so that the impact weight member 31 is movable integrally with the reciprocating rod 30. Further, there is provided a conversion mechanism 32 for converting the torque of the rotary shaft 271 of the motor 27 to a reciprocating movement in the axial directions of the reciprocating rod 30. The impact weight member 31 is shaped into a rectangular prism or a cylinder.

A guide 47 is provided under the impact weight member 31 to keep the impact weight member 31 from rotating, and to assure smooth reciprocating movement of the impact weight member 31. In the case of adopting an impact weight member 31 in the form of a rectangular prism, the guide 47 is shaped into a plate. In the case of adopting an impact weight member 31 in the form of a cylinder, a slide groove is formed in the impact weight member 31 and the guide 47 is provided with a rib operable to fit in the slide groove.

The conversion mechanism 32 includes a first wheel 272 attached on the rotary shaft 271 of the motor 27, a first pivotal shaft 33 attached on the second support member 28 on the same axis as the rotary shaft 271, a second wheel 331 rotatably mounted on the pivotal shaft 33, a driving rod 34 extending between the first wheel 272 and the second wheel 331 whose both ends are attached at off-center positions with respect the axis of the first and second wheels 272 and 331, a first connecting disk 35 rotatably mounted on the driving rod 34, and a first connecting pin 351 provided in an upper portion of the first connecting disk 35 and extending in a width direction of the housing 21 of the gun 20.

Also, the conversion mechanism 32 is provided with a second connecting disk 36 mounted on the reciprocating rod 30. The second connecting disk 36 is rotatable around the reciprocating rod 30, but is held unmovable in the axial directions of the reciprocating rod 30. A second connecting pin 361 is provided in a lower portion of the second connecting disk 36. The second connecting pin 361 extends in a width direction of the housing 21 of the gun 20.

A second pivotal shaft 38 is attached on the first support member 26. An axis of the second pivotal shaft 38 agrees with the axis of the reciprocating rod 30. The second pivotal shaft 38 is mounted with a third connecting disk 39. The third connecting disk 39 is rotatable around the second pivotal shaft 38, but is held unmovable in the axial directions of the second pivotal shaft 30. A third connecting pin 391 is mounted in a lower portion of the third connecting disk 39. The third connecting pin 391 extends in a width direction of the housing 21 of the gun 20.

There are further provided a first link member 42 and a second link member 43. One end of the first link member 42 is rotatably connected at the first connecting pin 351 of the first connecting disk 35 while the other end is rotatably connected at the second connecting pin 361 of the second connecting disk 36. One of the second link member 43 is rotatably connected at the first connecting pin 351 of the first connecting disk 35 while the other end is rotatably connected at the third connecting pin 391 of the third connecting disk 39. The combination of the first and second link members 42 and 43 comes into the V-form from the side view of the housing 21 of the gun 20. The first connecting pin 351 is at the vertex of the V-form of the first and second link members 42 and 43.

When the rotary shaft 271 of the motor 27 is turned in a specified direction, e.g., a clockwise direction as viewed from the rear of the gun housing 21, the driving rod 34 revolves around the axis of the first and second wheels 272 and 331 together with a rotation of the first and second wheels 272 and 331. At this time, as will be described later, the first link member 42 and the second link member 43 swing in accordance with the revolution of the driving rod 34, thereby changing the vertex angle of the V-form combination. Consequently, the reciprocating rod 30 and the impact weight member 31 move reciprocatingly back and forth along the barrel 211 of the housing 21 of the gun 20.

Figure 3:
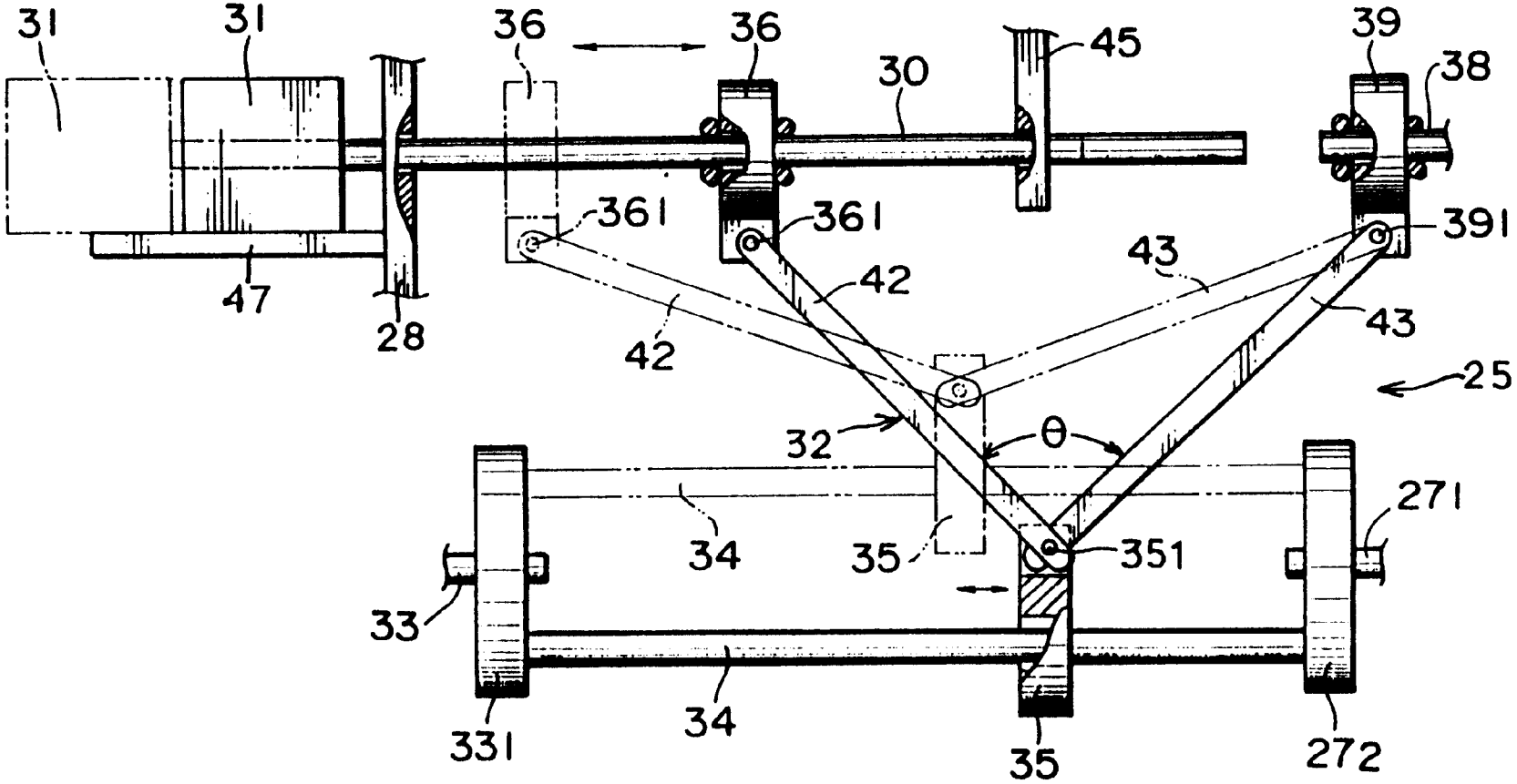
FIG. 3 is a side view of an impact generator provided in the gun.

FIG. 3 illustrates how the rotation of the rotary shaft 271 of the motor 27 is converted into the reciprocating movement of the reciprocating rod 30 attached with the impact weight member 31. Specifically, in the process of downward movement of the driving rod 34, the driving rod 34 goes away from the reciprocating rod 30, and the vertex angle of the V-form combination of the first and second link members 42 and 43 thereby becomes smaller. The other end of the second link member 43 is connected to the third connecting disk 39 which is held unmovable in the axial directions of the second pivotal shaft 38. Consequently, the reciprocating rod 30, which is movable reciprocatingly along the barrel and integrally connected with the second connecting disk 36, moves to the position represented by the solid lines from the position represented by the phantom lines, that is, in the backward direction of the barrel, together with the backward swing of the first link member 42. Thus, the impact weight member 31 carried by the reciprocating rod 30 moves backward.

In contrast, when the driving rod 34 moves upward together with the clockwise rotation of the first and second wheels 272 and 331, in other words, the driving rod 34 comes closer to the reciprocating rod 30, the vertex angle of the V-form combination becomes greater. Consequently, the reciprocating rod 30 moves to the position represented by the phantom lines from the position represented by the solid lines with the forward swing of the first line member 42. Thus, the impact weight member 31 carried by the reciprocating rod 30 moves forward.

Accordingly, in one revolution of the driving rod 34 around the axis of the rotary shaft 271, the reciprocating rod 30 and the impact weight member 31 move back and forth one time along the barrel 211. The speed of the back and forth movement of the impact weight member 31 follows the rotational speed of the rotary shaft 271, that is, the rotational speed of the motor 27. In this embodiment, the rotational speed of the motor 27 is set so that the reciprocating rod 30 can move back and forth several to tens times per second.

A kinetic energy emerges during the back and forth movement of the impact weight member 31. Each time the direction of the reciprocating movement of the shaft 30 is changed, the kinetic energy is transmitted onto the housing 21 of the gun 20. In this way, impacts simulating impacts which would occur in a large number of successive actual shootings are generated in the direction of the barrel 211 of the housing 21 of the gun 20. The kinetic energy is changed by changing the weight of the impact weight member 31. Accordingly, the magnitude of impact onto the housing 21 of the gun 20 can be controlled.

Next, an exemplary operation of the video game system provided with the simulative rapid-firing gun 20 will be described. A game starts when a token is inserted and a start button is pushed. When the player pulls the trigger 23 of the simulative quick-firing gun 20 to shoot at a target displayed on the display portion 11, the micro-switch 2 turns on. The turn-on signal is sent to the control portion 12 through the cable 13 as a shooting signal.

During the time that the trigger 23 is pulled, a control signal directing the motor drive is issued from the control portion 12 through the cable 3. In response to the control signal, the motor 27 is driven. Consequently, successive impacts are generated onto the housing 21 of the gun 20 by the aforementioned operation of the conversion mechanism 32.

Also, the control portion 12 executes the light detection operation in response to the shooting signal. The display screen is scanned by the electron beam to produce a luminous image. The light detector 22 detects light from a luminous spot of the display screen when the trigger 23 is pulled or a shooting is performed. The position of the luminous spot is calculated by the horizontal and vertical counters. The control portion 12 determines based on the calculated position whether the luminous spot is a target position. In other words, the judgement is executed whether the shot bullet hit the target.

Thereafter, upon the trigger 23 being released, the microswitch 24 turns off. At this time, the control portion 12 stops sending out the motor drive signal to stop the driving of the motor 27. Consequently, no impact generates onto the housing 21 of the gun 20. In this way, the stimulated quick-firing gun generates successive impacts only during the time when the trigger 23 is pulled. The player can enjoy the feeling of actually firing a real machine gun. Also, the simulative quick-firing gun of the present invention can provide an enhanced simulative play conditions for such games.

According to the present invention, the following modifications may be appreciated. In the foregoing embodiment, the impact weight member 31 is mounted at the front end of the reciprocating rod 300. However, the impact weight member 31 may be mounted on an intermediate portion or a rear end of the reciprocating rod 300. Also, it may be appreciated to form a projection at such a position of the housing 21 as to come into contact with the impact weight member 31 in the reciprocating movement to thereby increase the magnitude of impact. Further, it may be appreciated to use a reciprocating rod having a larger diameter or an increased weight. In this case, no impact weight member is specially required.

In the foregoing embodiment, the reciprocating rod 30 is mounted on the second support member 28 at the forward position while the second pivotal shaft 38 is mounted on the first vertical support member 26 at the rearward position. According to the present invention, however, it may be possible to mount the reciprocating rod 30 on the first support member 26 at the rearward position while mounting the second pivotal shaft 38 on the second support member 28 at the forward position. Further, it may be appreciated to incline the reciprocating rod 30 with respect to the axis of the barrel 211 to orient the forward end of the reciprocating rod 30 upward or downward.

In the foregoing embodiment, the first connecting disk 35 is mounted rotatably on the driving rod 34. However, it may be appreciated to mount the driving rod 34 rotatably on the first and second wheels 272 and 331, and mount the first connecting disk 35 fixedly on the driving rod 34.

Also, the second connecting disk 36 is mounted rotatably on the reciprocating rod 30 in the foregoing embodiment. However, it may be appreciated to mount the reciprocating rod 30 rotatably on the second support member 28 and the third support member 45, and mount the second connecting disk 36 fixedly on the reciprocating rod 30.

Further, the third connecting disk 39 is mounted rotatably on the second pivotal shaft 38 in the foregoing embodiment. However, it may be possible to mount the second pivotal shaft 38 rotatably on the first support member 26 and mount the third connecting disk 39 fixedly on the second pivotal shaft 38.

Figure 4:
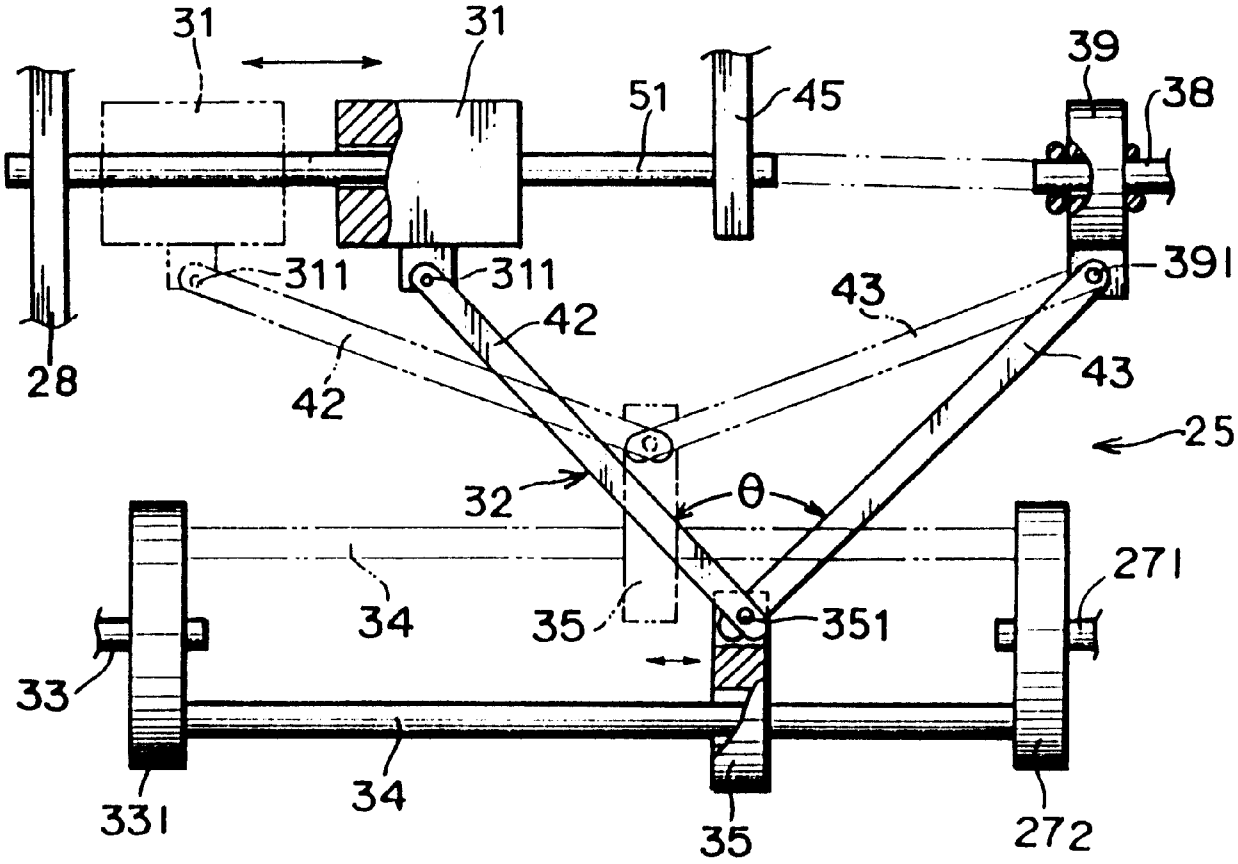
FIG. 4 is a side view of another impact generator provided in the gun.

In the foregoing embodiment, furthermore, the impact weight member 31 is reciprocatingly moved by the reciprocating rod 30. However, according to the present invention, it may be possible to eliminate the reciprocating rod 30. Specifically, as shown in FIG. 4, a third pivotal shaft 51 is disposed between the second support member 28 and the third support member 45. An impact weight member 31 is mounted loosely on the third pivotal shaft 51 so that the impact weight member 31 is reciprocatingly movable on and rotatable about the third pivotal shaft 51. The impact weight member 31 is provided with a fourth connecting pin 311 in a lower portion thereof. The end of the first link member 42 is rotatably connected at the fourth connecting pin 311.

In this construction, the impact weight member 31 reciprocatingly moves along the third pivotal shaft 51 with the revolution of the first connecting disk 35 and the expansion and contraction of the V-form combination of the first and second link members 42 and 43. In this construction, the second connecting disk 36 can be eliminated as well as the reciprocating rod 30. Accordingly, the construction of the conversion mechanism 32 can be more simplified.

Moreover, in the foregoing embodiments, the conversion mechanism 32 is constructed by two link members, i.e., the first link member 42 and the second link member 43. However, according to the present invention, the second link member 43 may be eliminated. Specifically, with the second link member 43 being removed, the first connecting disk 35 is mounted on the driving rod 34 in such a manner as to be rotatable about the driving rod 34 but be unmovable in the axial directions of the driving rod 34. In this construction, the second pivotal shaft 38 and the third connecting disk 39 can be eliminated as well as the second connecting link member 43. Thus, the construction of the conversion mechanism 32 can be more simplified.

Furthermore, in the foregoing embodiments, the conversion mechanism 32 is provided with the V-formed link member combination. However, according to the present invention, in place of the V-formed link member combination, a crank link member may be used to convert the torque of the motor 27 to the reciprocating movement of the reciprocating rod 30 and the impact weight member 31.

Furthermore, in the modification shown in FIG. 4, the third pivotal shaft 51 is mounted fixedly on the second support member 28 and the third support member 45 with the impact weight member 31 being loosely mounted on the third pivotal shaft 51. However, it may be appreciated to mount the third pivotal shaft 51 rotatably on the second support member 28 and the third support member 45, but to mount the impact weight member 31 fixedly on the third pivotal shaft 51.

Furthermore, in the modification shown in FIG. 4, the second pivotal shaft 38 and the third pivotal shaft 51 are provided independently from each other. However, a single shaft may be used to perform the function of these shafts 38 and 51 in place of these shafts 38 and 51 as represented by the phantom lines, thereby simplifying the construction of the conversion mechanism much more. Also, in this construction, the third support member 45 can be eliminated as well as the second and third pivotal shafts 38 and 51.

In the foregoing embodiment, the inventive simulative quick-firing gun 20 is applied to the video game system. However, the simulative quick-firing gun 20 may be used without combination with a video game system but simply as a gun toy. In this case, a battery for driving the motor 27 is incorporated into the housing 21 of the gun 20. In addition, a sound generator is provided in the housing 21 of the gun 20 to produce sounds when the trigger 23 is pulled.

As described above, a simulative quick-firing gun of the present invention comprising the housing 21, the shooting detector including the micro-switch 24 provided in the housing 21 for detecting a shooting operation, and the impact generator provided in the housing 21 for generating an impact in accordance with detection of a shooting. The impact generator is provided with the motor 27, the impacter including the reciprocating rod 30 and the impact weight member 31 movable reciprocatingly in a specified direction of the housing 21, and the conversion mechanism 32 for converting a torque of the motor 27 to a reciprocating movement of the impacter.

In this construction, when a shooting operation is detected by the shooting detector, the impacter is reciprocatingly moved. An impact generates when the impacter changes its movement direction. Accordingly, the inventive simulative quick-firing gun makes it possible to give the player the feeling of actual shootings. Also, a great number of successive impacts can be generated easily. Thus, the inventive simulative quick-firing gun is useful for sophisticated shooting video games.

The conversion mechanism may be constructed by the driving rod 34 connected with the motor 27 and revoluvable around an axis of the motor 27, and the linking mechanism including the first and second link member 42 and 43 for operatively connecting the driving rod 34 with the impacter in such a way that the impacter reciprocatingly moves in the specified direction with a revolution of the driving rod 34.

The impacter may be constructed by the impact weight member 31, and the reciprocating rod 30 carrying the impact weight member 31 on an end thereof, and operatively connected with the driving rod 34 by the linking mechanism. Also, the impacter may be constructed by the shaft 51 extending in the specified direction, and the impact weight member 31 movable along the shaft 51, and operatively connected with the driving rod 34 by the linking mechanism.

The linking mechanism may be constructed by the first link member 42 for operatively connecting the driving rod 34 and the impacter, the second link member 43 for operatively connecting the driving rod 34 and the pivotal shaft 38 fixedly attached onto the housing 21. Further, there may provided the first connecting member 35 mounted rotatably on the driving rod 34, and swingably connected with the first and second link members 42 and 43, the second connecting member 36 mounted rotatably on the impacter, and swingably connected with the first link member 42, and the third connecting member 43 mounted rotatably on the pivotal shaft 38, and swingably connected with the second link member 43.

Also, the linking mechanism may be constructed by the first link member 42 for operatively connecting the driving rod 34 and the impact weight member 31, the second link member 43 for operatively connecting the driving rod 34 and the pivotal shaft 38 fixedly attached onto the housing 21, the first connecting member 34 mounted rotatably on the driving rod 34 and swingably connected with the first and second link members 42 and 43, and the second connecting member 39 mounted rotatably on the pivotal shaft 38 and swingably connected with the second link member 43. The shaft 51 and the pivotal shaft 38 may be integrally formed into a single shaft.

Although the preferred embodiments of the present invention have been described above, it should be understood that the present invention is not limited thereto and that other modifications will be apparent to those skilled in the art without departing from the spirit of the invention.

What is claimed is:

1. A simulative quick-firing gun, comprising:

a housing;

a shooting detector provided in the housing for detecting a shooting operation; and an impact generator provided in the housing for generating an impact in accordance with detection of a shooting, the impact generator including:

a motor;

an impacter movable reciprocatingly in a specified direction of the housing, said specified direction being substantially parallel to a rotational shaft of the motor; and a conversion mechanism for converting a torque of the motor to a reciprocating movement of the impacter.

2. A simulative quick-firing gun according to claim 1, wherein the conversion mechanism includes:

a driving rod operably connected eccentrically with the rotational shaft of the motor such that the driving rod extends parallel to the rotational shaft and revolves around the rotational shaft; and a linking mechanism for operatively connecting the driving rod with the impacter in such a way that the impacter reciprocatingly moves in the specified direction with a revolution of the driving rod.

3. A simulative quick-firing gun according to claim 2, wherein the impacter includes:

an impact weight member; and a reciprocating rod carrying the impact weight member on an end thereof, and operatively connected with the driving rod by the linking mechanism.

4. A simulative quick-firing gun according to claim 2, wherein the impacter includes:

a shaft extending in the specified direction; and an impact weight member movable along the shaft, and operatively connected with the driving rod by the linking mechanism.

5. A simulative quick-firing gun according to claim 2, wherein the linking mechanism includes:

a first link member for operatively connecting the driving rod and the impacter;

a second link member for operatively connecting the driving rod and a pivotal shaft fixedly attached onto the housing.

6. A simulative quick-firing gun according to claim 5, wherein the linking mechanism further includes:

a first connecting member mounted rotatably on the driving rod, and swingably connected with the first and second link members;

a second connecting member mounted on the impacter, and swingably connected with the first link member; and a third connecting member mounted on the pivotal shaft, and swingably connected with the second link member.

7. A simulative quick-firing gun, comprising:

a housing;

a shooting detector provided in the housing for detecting a shooting operation; and an impact generator provided in the housing for generating an impact in accordance with detection of a shooting;

the impact generator including a motor, an impacter movable reciprocatingly in a specified direction of the housing, and a conversion mechanism for converting a torque of the motor to a reciprocating movement of the impacter;

the conversion mechanism including a driving rod connected with the motor and revolvable around an axis of the motor, and a linking mechanism for operatively connecting the driving rod with the impacter in such a way that the impacter reciprocatingly moves in the specified direction with a revolution of the driving rod;

the linking mechanism including a first link member for operatively connecting the driving rod and the impacter, a second link member for operatively connecting the driving rod and a pivotal shaft fixedly attached onto the housing, a first connecting member mounted rotatably on the driving rod, and swingably connected with the first and second link members, a second connecting member mounted on the impacter and swingably connected with the first link member, and a third connecting member mounted on the pivotal shaft and swingably connected with the second link member;

the impacter including an impact weight member, and a reciprocating rod carrying the impact weight member on an end thereof and mounted with the second connecting member unmovably in an axial direction thereof.

8. A simulative quick-firing gun, comprising:

a housing;

a shooting detector provided in the housing for detecting a shooting operation;

an impact generator provided in the housing for generating an impact in accordance with detection of a shooting;

the impact generator including a motor, an impacter movable reciprocatingly in a specified direction of the housing, and a conversion mechanism for converting a torque of the motor to a reciprocating movement of the impacter;

the conversion mechanism including a driving rod connected with the motor and revolvable around an axis of the motor, and a linking mechanism for operatively connecting the driving rod with the impacter in such a way that the impacter reciprocatingly moves in the specified direction with a revolution of the driving rod;

the impacter including a shaft extending in the specified direction, and an impact weight member movable along the shaft and rotatable around the shaft;

the linking mechanism including a first link member for operatively connecting the driving rod and the impact weight member, a second link member for operatively connecting the driving rod and a pivotal shaft fixedly attached onto the housing, a first connecting member mounted rotatably on the driving rod, and swingably connected with the first and second link member, and a second connecting member mounted rotatably on the pivotal shaft and swingably connected with the second link member.

9. A simulative quick-firing gun according to claim 8, wherein the shaft extending in the specified direction and the pivotal shaft are integral.

* * * * *